US005681456A

United States Patent [19]

Delport

[11] Patent Number: 5,681,456

[45] Date of Patent: Oct. 28, 1997

[54] PRESSURE-VACUUM FLUID HANDLING SYSTEM AND METHOD OF REMOVING AND REPLACING ENGINE COOLANT

[76] Inventor: Wes Delport, 307 West St., Nixa, Mo. 65714

[21] Appl. No.: 551,115

[22] Filed: Oct. 31, 1995

[51] Int. Cl.[6] ..... C02F 1/52

[52] U.S. Cl. ..... 210/167; 210/198.1; 210/201; 210/203; 210/206; 210/257.1; 210/258; 123/41.55; 123/41.14; 165/1; 165/95

[58] Field of Search ..... 210/258, 198.1, 210/201, 203, 205, 206, 167, 257.1; 123/41.55, 41.14; 165/1, 95

[56] References Cited

U.S. PATENT DOCUMENTS

| | | | |
|---|---|---|---|
| 4,083,399 | 4/1978 | Babish et al. | 165/95 |
| 4,791,890 | 12/1988 | Miles et al. | 165/95 |
| 4,793,403 | 12/1988 | Vataru et al. | 165/95 |
| 4,899,807 | 2/1990 | Vataru et al. | 165/95 |
| 4,946,595 | 8/1990 | Miller, Jr. | 210/651 |
| 5,021,152 | 6/1991 | Filowitz et al. | 210/712 |
| 5,223,144 | 6/1993 | Woyciesjes et al. | 210/664 |
| 5,318,700 | 6/1994 | Dixon et al. | 210/167 |

*Primary Examiner*—Neil McCarthy
*Attorney, Agent, or Firm*—Richard J. Grundstrom

[57] ABSTRACT

A complete fluid handling system for automotive engine coolant that is installed within an automotive service center. The system delivers either new coolant in a 50% antifreeze—50% water ratio or recycled coolant also in a 50/50 ratio. The coolant is mixed in a new coolant delivery tank and is delivered under pressure to a service device at each service bay. The recycled coolant is also delivered to the services device at the service bays from a recycled coolant delivery tank under pressure. Recovery of coolant can be directed to either a waste holding tank or to a recycling tank. If directed to recycling tank the coolant is cleaned and treated to restore the coolant to the proper chemical balance.

The system enables a technician to conveniently and effectively remove and replace engine coolant. The system enables safe and an immediate access to hot cooling systems, including overheated engines. The majority of the system, other then the plumbing and attachments at each individual service bay, is located in a central location. This allows use of the system in several bays simultaneously.

18 Claims, 6 Drawing Sheets

PRESSURE-VACUUM FLUID HANDLING SYSTEM AND METHOD OF REMOVING AND REPLACING ENGINE COOLANT

BACKGROUND OF THE INVENTION

The present invention relates to a pressure-vacuum fluid handling system and a method of removing and replacing engine coolant using a pressure-vacuum fluid handling system. More particularly, this invention relates to a centrally located pressure-vacuum fluid handling system installed within a service center with attachment devices located at each service bay within the service center. The attachment devices are used at service bays for removing and replacing engine coolant.

Practically every passenger car and truck on the road today shares a common ingredient, ethylene glycol, used as an integral component in the cooling system, protecting engine components against corrosive and erosive attack and providing enhanced freeze/boil protection. A 50/50 mixture of glycol and water comprises the antifreeze mixture. In colder climates the mixture can be as high as 70% antifreeze.

Preventing freeze-ups is only part of the coolant's job. Engine coolant also prevents boilover, a problem that can occur in very warm climates, especially when high outdoor temperatures combine with punishing temperatures and the slow-and-go driving conditions of freeways and congested metropolitan areas.

Another important function of coolant is protection against acid corrosion, a potential problem in any climate. All coolant contains certain additives, called buffers or inhibitors, designed to neutralize acids as they form in the cooling system. As coolant ages, these buffers are gradually depleted and acid corrosion begins.

Left unchecked, acids can eat away at cooling system components, causing water pump failure, metal corrosion and system leaks. The problem of acid corrosion is as common as it is potentially devastating. Repair costs resulting from corrosion damage to engine components can be substantial.

Modern engines are particularly susceptible to acid corrosion due to increased use of aluminum and aluminum alloys in engine components. Aluminum acts as a catalyst in acid coolant that results in electrolytic action and acid corrosion. The result is pitting and severe corrosion damage.

Because antifreeze deteriorates with use and age, it must be replaced periodically. This generally includes flushing the engine to remove the old contaminated coolant and replacing it with a new mixture of ethylene glycol and water. Numerous service centers across the world perform services on coolant systems on all types of vehicles.

A service center generally performs numerous different services on an automobiles and has to be equipped to do so. Automotive service centers utilize a large selection of tools and equipment. Various services require special tools and equipment, as does the service of coolant systems. Equipment storage requires a substantial amount of space and tends to crowd and clutter work space in service bays. In the prior art, cooling system service equipment consist of a service cart that is wheeled to the service bay. Service centers, because of cost and space limitation, will only have one or two service carts. These are wheeled to the service bays as needed. This practice adds additional equipment clutter in the bay and presents a timing problem when multiple services have to be performed at the same time. These problems are eliminated by this invention. The equipment is centrally located in a convenient location and attachment devices are plumbed to each of the service bays, as are water, air and oil. This invention eliminates bay clutter, the expense of having to purchase several service carts, and provides the ability to perform service on several vehicle coolant systems simultaneously.

The coolant in cooling systems of vehicles brought in for service is hot and under pressure. The pressure-vacuum fluid handling system of this invention eliminates the need for a cooling down period and allows the mechanic to begin service on a hot cooling system immediately.

Spent coolant can be recycled, the chemistry can be replenished and the mixture can be restored to a usable condition. The pressure-vacuum fluid handling system of this invention recycles contaminated coolant and restores coolant chemistry to original chemistry specification, making it available for use within a short period of time. In addition, waste coolant that cannot be recycled is stored automatically in a waste storage tank.

Accordingly, it is an object of the present invention to provide a pressure-vacuum fluid handling system that has a centrally located system with individual attachment devices at individual bays.

Another object of the present invention is to provide a pressure-vacuum fluid handling system that is constructed to allow a single system to provide service to a number of vehicles in different work bays at the same time.

A further object of the present invention is to provide a pressure-vacuum fluid handling system that is adapted to remove and replace coolant from an engine's coolant system. The pressure-vacuum fluid handling system of this invention allows rapid service to a coolant system while hot and under pressure which eliminates the need for the engine to cool down before service.

Still another object of the present invention is to provide a pressure-vacuum fluid handling system that can recycle contaminated coolant, filter the coolant, restore the chemical inhibitors in the coolant and make it available for future use.

Still a further object of the present invention is to provide a pressure-vacuum fluid handling system that is adapted to collect contaminated waste coolant which cannot be recycled due to oil contamination for proper disposal.

SUMMARY OF THE INVENTION

To accomplish the foregoing and other objects of this invention there is provided a pressure-vacuum fluid handling system and more particularly a complete fluid handling system for automotive engine coolant that is installed within an automotive service center. The system delivers, exchanges and recycles engine coolant through attachments from the system installed in individual service bays.

The pressure-vacuum fluid handling system 10 generally consist of a central system containing a waste holding tank 12, a recycling tank 14, a plurality of filters 16, a new premixed coolant delivery tank 18, a recycled coolant delivery tank 20, a vacuum means 22, an injection means 24, a treatment means 26, and a delivery means 80. The vacuum means 22 supplies a vacuum to the waste holding tank 12 and the recycling tank 14 for drawing coolant from a coolant system into either the waste holding tank 12 or the recycling tank 14. The treatment means 26 adds chemicals, i.e. metal removers, for treatment of coolant within the recycling tank 14. The plurality of filters 16 is connected by appropriate plumbing between the recycling tank 14 and the recycled coolant delivery tank 20. The filters 16 are used for filtering out particulate as treated coolant is transferred between the recycling tank 14 and the recycled coolant delivery tank 20. The injection means 24 injects chemicals into the treated and filtered coolant to restore coolant to original chemical specifications. The new premixed coolant delivery tank 18 receives and mixes new anti-freeze and water to create a new premixed coolant. The delivery means 80 provides a means of extracting coolant under pressure from the recycled coolant delivery tank 20 and the new premixed coolant delivery tank 18.

Also included is a plurality of service devices 28. Each service device 28 is identical and is typically located at a service bay or in another area in which service on a coolant system is performed. Each of the service devices 28 have a plurality of ports 30. The ports 30 on each of the service device 28 are either suction ports 30 or pressure ports 30. One of the suction ports 30 is connected by a suction line 32 to the waste holding tank 12. Another suction port 30 is connected by a second suction line 34 to the recycling tank 14. Coolant from the coolant system is sucked from the coolant system through one of the suction ports 30 for transfer to either the recycling tank 14 or the waste holding tank 12. One pressure port 30 is connected by a pressure line 36 to the new premixed coolant delivery tank 18. Another pressure port 30 is connected by a second pressure line 38 to the recycled coolant delivery tank 20. The pressure ports 30 receives coolant under pressure from the new premixed coolant delivery tank 18 and the recycled coolant delivery tank 20 for delivery of coolant to the coolant system.

Attachment means 40 are included and are attachable to the automotive coolant system and the service device 28. These are the interface between the two systems. The attachment means 40 attach to the radiator, the upper radiator hose and the overflow port on the radiator as described below. Coolant from the coolant system is removed by suction and replaced under pressure though the attachment means 30 attached to the suction and pressure ports 30 on the service device 28.

These and other objects and features of the present invention will be better understood and appreciated from the following detailed description of the main embodiment thereof, selected for purposes of illustration and shown in the accompanying drawings.

DETAILED DESCRIPTION

Figure 1:
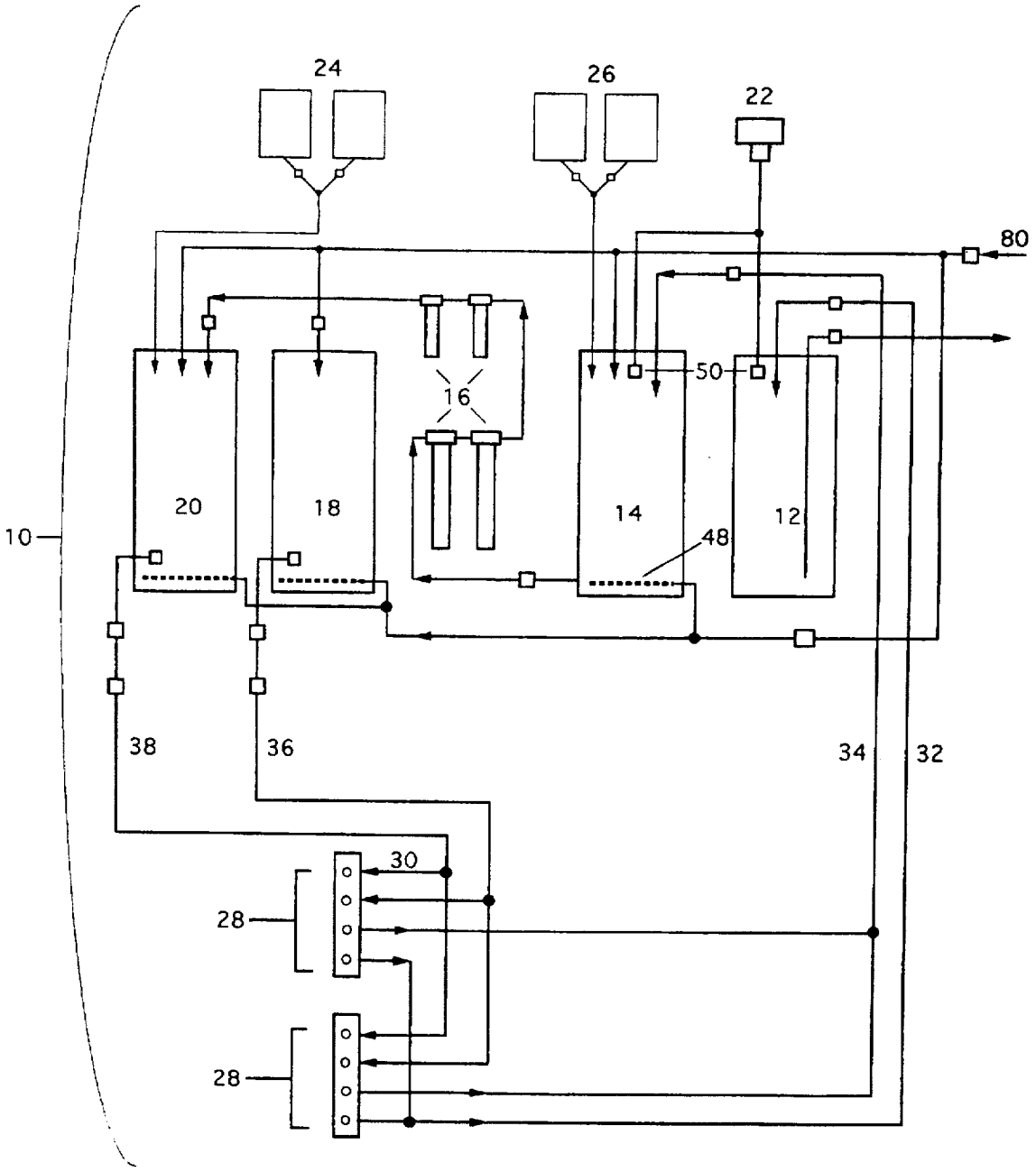
FIG. 1 is a schematic view of the pressure-vacuum fluid handling system.

Referring now to the drawings in general, there is shown the preferred embodiment for the pressure-vacuum fluid handling system of this invention.

The pressure-vacuum fluid handling system 10 is a complete fluid handling system for automotive engine coolant that is installed within an automotive service center. The system delivers either new coolant in a 50% antifreeze—50% water ratio or recycled coolant also in a 50/50 ratio. The new coolant is mixed in a new premixed coolant delivery tank 18 and is delivered via a pressure pump or air pressure to the service bays at a maximum pressure of 22 pounds per square inch. The recycled coolant is delivered to the service bays from a recycled coolant delivery tank 18 also via a pressure pump or air pressure. Recovery of coolant can be directed to either a waste holding tank 12 or to a recycling tank 14. If directed to recycling tank 14 the coolant is cleaned and treated to restore the coolant to the proper chemical balance.

The system enables a technician to conveniently and effectively remove and replace engine coolant. The system enables safe and an immediate access to hot cooling systems, including overheated engines. The majority of the system, other then the plumbing and attachments at each individual service bay, is located in a central location. This allows use of the system in several bays simultaneously.

The preferred embodiment and the best mode contemplated of the pressure-vacuum fluid handling system 10 of the present invention are herein described. However, it should be understood that the best mode for carrying out the invention hereinafter described is offered byway of illustration and not by the way of limitation. It is intended that the scope of the invention include all modifications which incorporate its principal design features.

Generally referring to FIG. 1, there are a plurality of service devices 28 which can be included. The specific number is determined by the size and needs of the service center in which the pressure-vacuum fluid handling system 10 is installed. Ideally there will be one service device 28 located at each individual service bays within a multiple bay service center. Each of the service devices 28 have a plurality of ports 30. In the preferred embodiment there will be four ports 30. The ports 30 are used for removal of recyclable coolant and contaminated coolant from an engine's coolant system and for delivery of recycled coolant and new coolant to the engine's coolant system. The ports 30, in the preferred embodiment, are a quick connect coupler to allow easy attachment of the attachment devices 40.

Figure 5:
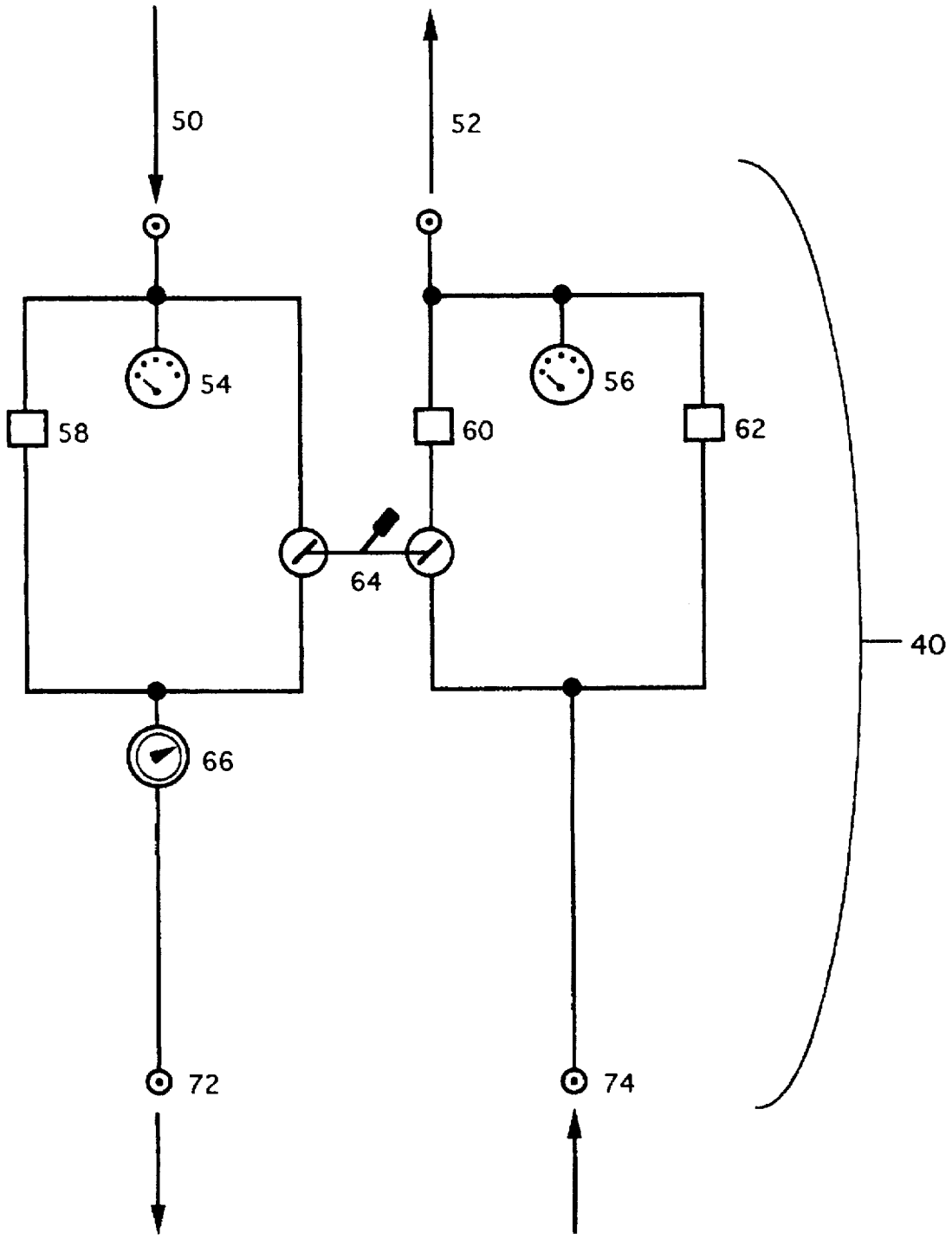
FIG. 5 is a schematical representation of the attachment device located at the service devices.
Figure 6:
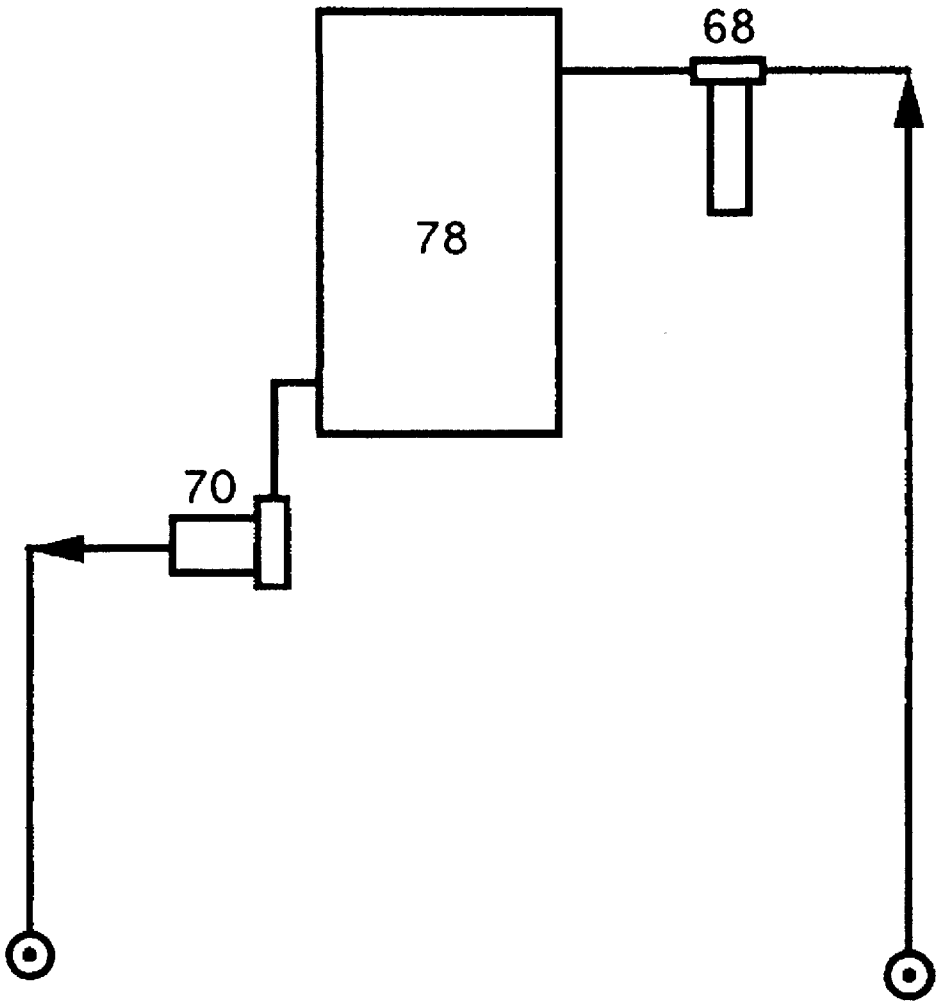
FIG. 6 is a schematical representation of a hot flush operation for a coding system.

The attachment device 40, schematically illustrated on FIG. 5, provides the interface between the engine coolant system and the ports 30 on the service devices 28. The attachment device 40 typically consists of several components as joined and connected as shown in FIG. 5. A pressure line 50 connects to either the pressure line 36 or 38 on service port 30 to provide either new coolant or recycled coolant, as desired. A quick connect coupler would typically be used to allow rapid connection and disconnection. A vacuum line 52 connects to suction lines 32 or 34 on the ports of the service device 28. Coolant is sucked through the vacuum line into either the waste holing tank or the recycling tank, as desired. This line also typically has a quick connect coupler. A pressure gauge 54 is provided on pressure line 50 to monitor coolant pressure. A vacuum gauge 56 is provided on vacuum line 52 to monitor vacuum. A pressure valve 58 is used to open or close coolant flow to provide coolant only. The pressure valve 58 would be used when the vacuum is valved off and coolant only is desired. A vacuum proportioning valve 60 is provided to control vacuum during dual operation of pressure and vacuum. A suction valve 62 is used to provide vacuum only when all other valves are closed. A Coupled dual valve 64 is provided to control pressure and vacuum when removing and replacing coolant. A flow meter 66 is also provided to monitor flow into the vehicle's coolant system. A pressure port 72, also a quick connect coupler, attaches to an appropriate adapter to provide coolant to the vehicle's coolant system. A vacuum port 74, also a quick connect coupler, attaches via an appropriate adapter to the vehicle's coolant system to remove the coolant.

An optional feature is to provide a hot flush operation of the cooling system of the vehicle using an in-line filter 68, a flush pump 70 and a fluid heating device 78. The flush pump 70 circulates the mixture of coolant and chemical cleaner through the filter 68 an fluid heating device 78.

Figure 2:
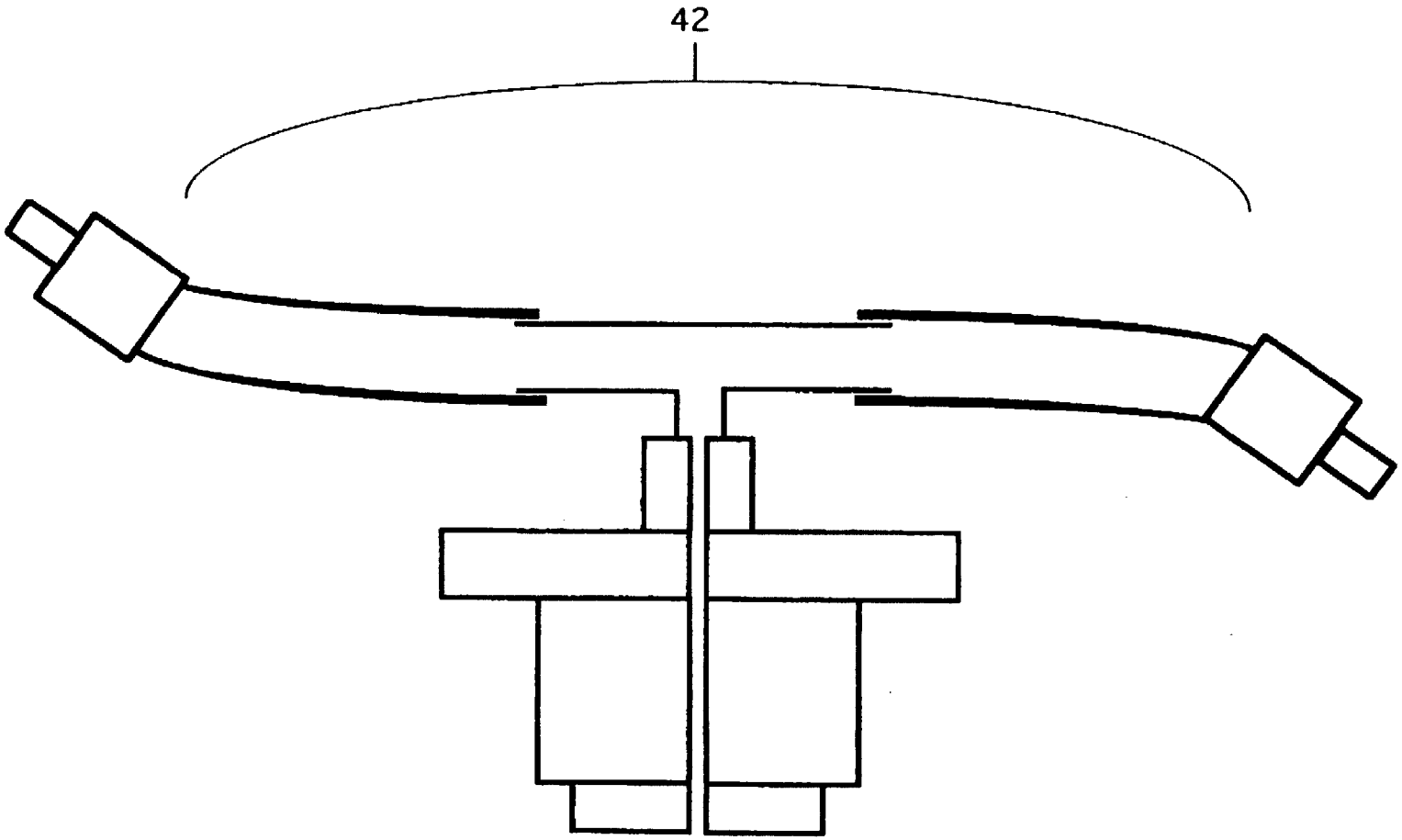
FIG. 2 is a representative sectional view of the radiator cap adapter.
Figure 3:
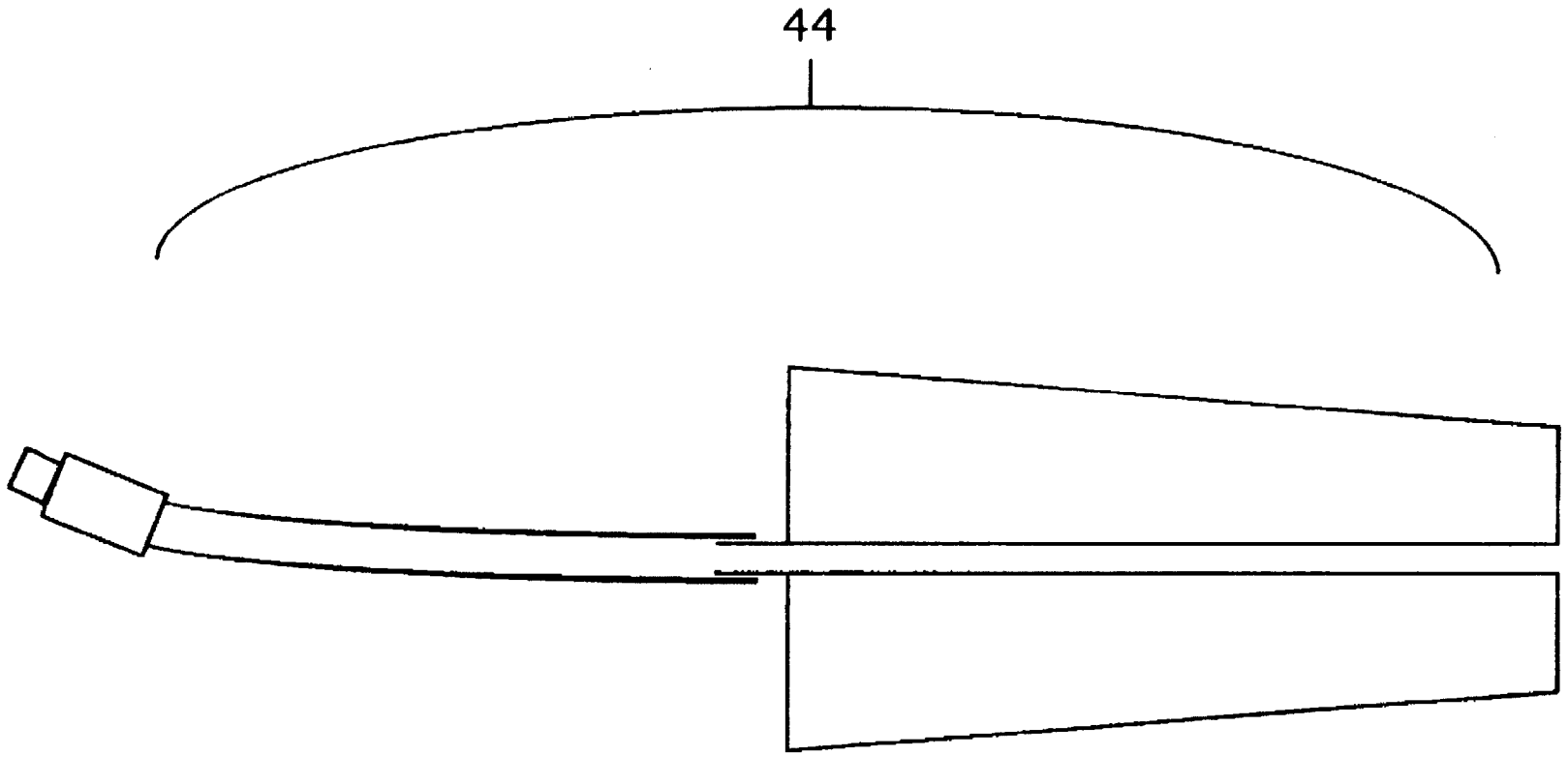
FIG. 3 is a representation sectional view of the male radiator adapter.
Figure 4:
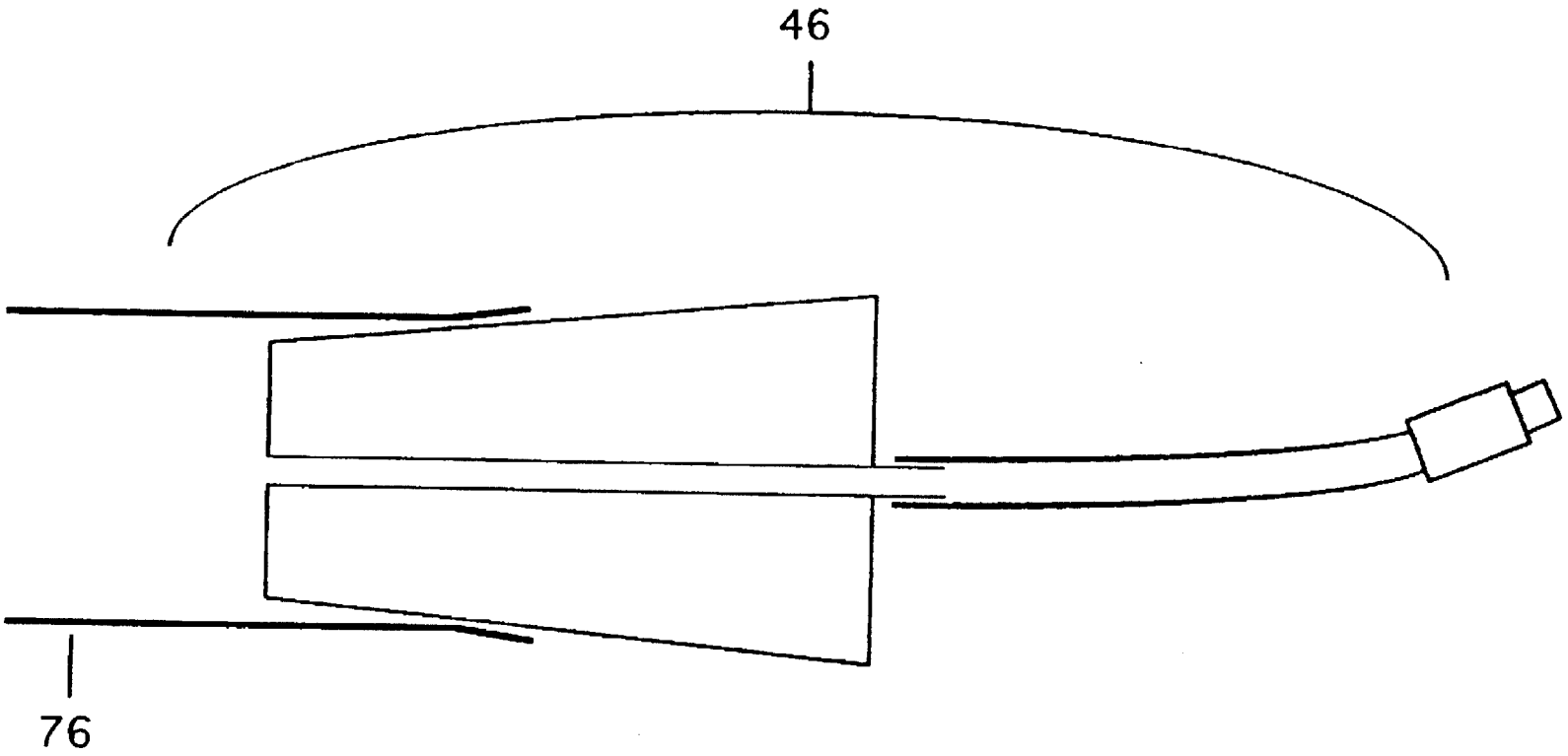
FIG. 4 is a representation sectional view of the female radiator hose adapter.

Included with the attachment device 40 are various adapters and hoses that connect to the radiator cap port, radiator overflow vent, upper radiator hose and to either the thermostat housing or upper radiator hose port on the radiator. These are illustrated on FIGS. 2, 3 and 4. The details of the sequence of attaching these adapters and hoses are given below. The adapters are radiator cap adapter 42, male radiator hose adapter 44, and female radiator hose adapter 46. These adapters attach to the pressure port 72 or vacuum port 74 as appropriate and later discussed. The male adapter 44 and the female adapter 46 are similar except that the male adaptor shaft has a longer tapered shaft. The female adapter 46 is shorter with a hose coupler 76. The hose coupler 76 is actually a plurality of short hoses of different sizes. The various sizes are supplied to fit the upper radiator hose port on the radiators of all the various vehicles. One end of the hose coupler 76 attaches to the radiator's upper radiator hose port and the other end attaches to the tapered shaft of the female adapter 46. The attachment device 40 and all the adapters are typically self contained in a cart for easy transportation, storage and use.

The waste holding tank 12 is located in a central location and plumbed with appropriate piping or conduit to one of the ports 30 on each of the service devices 28. The piping or conduit can be referred to as suction line 32. The waste holding tank 12 is for the collection and storage of coolant removed from an engine's coolant system that is to contaminated for recycling. The waste holding tank 12 will typically include a pickup port for removal of waste coolant from the waste holding tank 12 for shipment and proper disposal.

The recycling tank 14 is also located in a central location along with the waste holding tank 12. The recycling tank 14 is plumbed also plumbed with appropriate piping or conduit to one of the ports 30 at each of the service devices 28. This is the second suction line 34. The recycling tank 14 is used for the collection and treatment of recyclable coolant removed from a coolant system.

The treatment means 26 adds metal removers and other chemicals to the recyclable coolant in the recycling tank 14. The metal removers and chemicals used are well know in the art and are used in many other applications. The metal removers and chemicals cause metals and other matter in the coolant to precipitate so they can be removed by filtration.

The recycling tank 14 includes an agitation means 48 located within the recycling tank 14. The agitation means 48 mixes the coolant and chemical treatments added to the recyclable coolant and to prevent settling of contaminants and particulate within the recycling tank 14. In the preferred embodiment, the agitation means 48 is an aeration device located on the bottom of the recycling tank 14. The aeration device uses compressed air supplied by regulated shop air that is typically readily available or by an air compressor dedicated for this use. Other agitation means could also be used without departing from the scope and spirit of the invention described herein.

The treatment of recyclable coolant within the recycling tank 14 includes addition of chemicals for precipitation and solidification of dissolved and suspended matter within the coolant. The chemical are generally a series of metal removers which are well known in the art. After the chemicals are added for removal by the plurality of filters 16. In the preferred embodiment, two metals removers individually flow in equal volume from metal removal chemical dispenser to the recycling tank 14. They are mixed thoroughly for at least 5 minutes. Mixing, in the preferred embodiment as discussed, is accomplished by pumping air into the recycling tank 14. Once coolant has been mixed with both metal removers it can be passed through the filters 16 to be delivered to recycled coolant delivery tank 20.

The size of the recycling tank 14, as well as the waste holding tank 12 will vary depending on the facility and particular needs of the service center. The recycling tank 14 should hold all coolant desired to be recycled and large enough to justify the time to recycle or have an off site recycler come and pick up the recyclable coolant. The same applies to the waste holding tank 12. Tank size will vary but a 120 gallon tank should suit a small company.

Coolant travels to the recycling tank 14 and the waste holding tank 12 due to a vacuum placed on these tanks. A total of 20 inches of vacuum is used when 12 feet of head is being dealt with. Again total vacuum must vary to suit head encountered. An important factor in the setting the level of vacuum is approximately 8 inches of vacuum is needed at the service devices 28. Total vacuum can be easily adjusted until both levels are reached.

A vacuum means 22 provides the vacuum to the recycling tank 14 and the waste holding tank 12. In the preferred embodiment a vacuum pump is used. Vacuum is supplied to the tanks via a remote pump. This pump can be any style of pump as long as it can maintain the desired vacuum needed on a consistent basis. In the preferred embodiment, a wet seal pump is preferred to give longer service life. Check valves 50 are placed on the vacuum lines within the tanks 12 and 14. These close the line when liquids fill the tank.

The system includes a plurality of inline filters 16 between the recycling tank 14 and the recycled coolant delivery tank 20. The filters are used to clean the recyclable coolant. In the preferred embodiment, a series of four filters 16 are used. Filters 16 start at removing particulate with a 75 micron size and decrease to 30, 5 and 1 microns. Filters 16 are installed in series and typically last up to approximately 1000 gallons. Before the recyclable coolant is filtered it is treated with two metal removers in the recycling tank 14. These are added to cause the metals to join with each other in big enough sizes to insure the filters 16 will catch them.

The recycled coolant delivery tank 20 is also located centrally. The recycled coolant delivery tank 20 receives filtered recyclable coolant and is plumbed with appropriate piping or conduit from the plurality of filters 16. The recycled coolant delivery tank 20 collects filtered coolant and an injection system 24 adds chemicals to the coolant to restore the coolant to the correct chemical balance. The injection system 24 is attached to the recycled coolant delivery tank and injects the chemicals into contained coolant.

The chemicals added are typically called buffers or inhibitors. The inhibitors are added one at a time, with no more than 15 minutes between each application, to restore coolant chemical specifications. Complete mixing is required. Inhibitors flow from inhibitor holding tanks vie the injection means 24 to the recycled coolant delivery tank 20 in equal volume. All mixing is by air agitation, in the preferred embodiment. Once mixing is complete, a reading is taken to determine the antifreeze/water ratio. Extra antifreeze is added to get the mixture to the preferred 50/50 ratio. Again mixing should be done to insure quality.

The recycled coolant delivery tank 20 is plumbed with appropriate plumbing or conduit to one of the ports 30 at the service devices 28. This is a pressure line 38 that provides or delivers recycled coolant under pressure at the port 30 at each service device 28.

The new premixed coolant delivery tank 18 is located in a central location with the waste holding tank 12, recycling tank 14 and the recycled coolant delivery tank 20. The new premixed coolant delivery tank is plumbed with appropriate piping or conduit to one of the ports 30 at each service device. This is pressure line 36. The new premixed coolant delivery tank 18 receives and mixes new antifreeze and water in a predetermined ratio. In the preferred embodiment, the ratio is 50% antifreeze and 50% water. The new premixed coolant delivery tank 18 allows for bulk antifreeze to be purchased and mixed in volume with water to the desired 50/50 ratio. The new coolant is delivered to a coolant system through the conduit 36 and attachment device 40 to the coolant system.

The delivery means 80 provides coolant under pressure for delivering recycled coolant from the recycled coolant delivery tank 20 or new coolant from the new premixed coolant delivery tank 18. The coolant is delivered to the coolant system through the service devices 28 and attachment devices 40.

In the preferred embodiment, the delivery means 80 is regulated air pressure supplied from readily available shop air. A regulator, also included in the block designated as 80 on FIG. 1, is used to prevent over-pressurization. An air compressor could also be dedicated for this purpose if shop air is not available or if not available in sufficient quantity. Regulated air pressure is provided to the new premixed coolant delivery tank 18 and the recycled coolant delivery tank 20 to provide pressure for delivery of new or recycled coolant to the service devices 28.

The delivery means 80 could also be a liquid transfer pump. The pump would pump coolant at a regulated pressure from the new premixed coolant delivery tank 18 and the recycled coolant delivery tank 20 to the service device 28.

Coolant can be delivered by air pressure or pump pressure whichever is desired. However, total pressure is regulated to 20 pounds per square inch to insure no damage of hoses, radiators and heater cores in the coolant systems.

Coolant is delivered to the service device 28 from either the new premixed coolant delivery tank 18 or from the recycled coolant coolant delivery tank. This election of source is made by coupling the adapters to appropriate delivery ports 30 on the service device 28. Suction and removal of spent coolant is accomplished by connection to one of the suction ports 30 on the service device 28. If the coolant is of desired state to recycle it is handled by attachment to the port having suction from the recycling tank 14. If condition of the spent coolant is undesirable you can elect to have it taken to the waste tank by connection to the port having suction from the waste holding tank 12.

Both suction and pressure lines to the service device 28 are installed anywhere possible to gain access to all desired work bays. Typical installation is overhead and on side walls. Allowances have to be made with amount of head you create by mounting plumbing high. Both pressure and suction pumps must be properly sized to match the work load. All calculations to determine sizes of pumps and pressures must also reflect the amount of work stations installed.

All lines have check valves to insure one way flow direction only. These are shown as blocks in FIG. 1 but are not numbered. All tanks have filling access ports (not shown) to allow for easy first time filling. All serviced devices 28 or work stations have the same access to all tanks. The total number of service device 28 is only limited by pump volume.

Procedure for using the pressure-vacuum fluid handling system is as follows: Many times an automobile is at operating temperature when service is to be done. Most mechanics would be forced to wait hours to be safe from burns. By disconnecting the overflow tube we gain an access point to the radiator. Applying light suction to this port will cause the radiator cap to allow unsafe pressure and steam to be vented directly to suction line and safely removed from any potential exposure to the mechanic. Once excess pressure and steam is safely removed the radiator cap can be loosened and removed. Safe access can be achieved easily and very efficiently.

Once the radiator cap is removed the radiator cap adapter 42 set can be installed to the radiator cap port. At this point the overflow tube must be re-installed and clamped shut with a vise clamp or similar device. A strong suction is applied which will begin to remove coolant from the radiator. The amount of coolant removed will very between ¼ and ⅓ of capacity of the radiator. Since the system is not vented a vacuum will be created as coolant is removed. Once the vacuum within the cooling system equals the vacuum pressure of the pressure-vacuum fluid handling system 10 a dead lock will occur. At this point, the upper radiator hose should collapse in most instances. This insures that no coolant is left in the upper radiator hose.

The upper radiator hose is disconnected at one end. This is accomplished easily without a mess because a portion of the coolant has been sucked out. The end to disconnect is determined by which end has the easiest access to hose clamps. The male hose adapter 44 is now inserted into the exposed end of upper radiator hose and clamped. The exposed upper radiator port or thermostat hosing receives the female hose adapter 46. At this time the suction hose is disconnected from the radiator cap adapter 42 and suction from the service device 28 is then applied to the adapter 44 or 46 whichever faces the radiator. A quick connect coupler would typically be used to allow rapid connection and disconnection. Coolant under pressure from the service device 28 is then applied to the hose adapter 44 or 46 facing the thermostat housing. At this time the radiator cap adapter 42 is removed from the radiator cap port. The radiator cap is reinstalled to fully seal the coolant system again.

Applying proportioned suction and pressure, from the service device 28, at the same time exchanges coolant quickly. New coolant is being pumped into system towards the thermostat. The thermostat opens with the fluid pressure. New coolant then flows in reverse of the regular pathway through the engine block and through the heater core and back towards the radiator. Once drawn through radiator it is removed via the upper radiator port to the suction line 32 or 34 which is either directly connected to the upper radiator port or passes through upper radiator hose to get to suction line, whichever is necessary due to access option exercised.

Once complete exchange has been achieved, verified by flow meter, an extra 2–3 liters is installed to avoid any cross contaminants between new and old fluids. The pressure line can now be disconnected as well as the suction line. The suction line is now connected to the hose adapter 44 or 46 that faces the thermostat. Suction is then applied to remove fluid trapped between the hose adapter and thermostat. Suction line can now be removed and both sets of hose adapters can be removed. The upper radiator hose can now be reconnected to the radiator port. At this time system is approximately ¾ full. The balance of radiator and upper radiator hose needs to be refilled without leaving any air. This is accomplished by connecting radiator cap adapter 42 to the radiator cap port. Followed by connecting the vacuum line and pressure line to radiator cap adapter hose connections. Suction is applied first to remove all air left in the system, then light pressure installs coolant into the void. Complete fill is accomplished, but a fluid pressure still remains to be relieved. The pressure is relieved by releasing vise clamp previously placed on the overflow hose. Any extra fluid is released to overflow container allowing the radiator cap adapter to be removed without spillage.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A pressure-vacuum fluid handling system comprising:

a plurality of service devices, with one service device located at each individual service bays within a multiple bay service center, each of said service devices having a plurality of ports, said ports for removal of recyclable coolant and contaminated coolant from an engine's coolant system and for delivery of recycled coolant and new coolant to the engine's coolant system;

a plurality of attachment devices attachable to said ports on said service devices and for attachment to the coolant system of a vehicle;

a waste holding tank plumbed with a conduit to one of said ports on each of said service devices, said waste holding tank for collection and storage of coolant removed from an engine's coolant system;

a recycling tank plumbed with a conduit to one of said ports at each of said service devices, said recycling tank for collection and treatment of recyclable coolant removed from a coolant system;

a treatment means to inject chemical treatments into said recycling tank to precipitate metals and contaminants in recyclable coolant;

a vacuum means providing a vacuum to said recycling tank and said waste holding tank for drawing coolant from the coolant system through said conduit attached to said ports and said attachment devices attached to the coolant system;

a plurality of filters in a fluid connection plumbed to said recycling tank, said filters for filtering recyclable coolant from said recycling tank;

a recycled coolant delivery tank plumbed with a conduit from said plurality of filters for collection of coolant filtered by said plurality of filters;

an injection system attached to said recycled coolant delivery tank for injecting chemicals into said recycled coolant delivery tank for restoring chemistry to recycled coolant within said recycled coolant delivery tank;

a delivery conduit from said recycled coolant delivery tank to one of said ports in each of said service devices, said delivery conduit delivering recycled coolant from said recycled coolant delivery tank to the coolant system through one of said ports and through said attachment device to the coolant system;

a new premixed coolant delivery tank plumbed with a conduit to one of said ports of each service device, said new premixed coolant delivery tank for receiving and mixing new antifreeze and water for delivery to a coolant system through said conduit and attachment device to the coolant system; and a delivery means for delivering recycled coolant and new coolant from said recycled coolant delivery tank and said new premixed coolant delivery tank to the coolant system through said service devices and attachment devices.

2. The pressure-vacuum fluid handling system as set forth in claim 1 in which said attachment devices comprises: a radiator cap adapter attachable to a radiator cap port on the radiator of the coolant system; a male radiator hose adapter for attachment to a radiator hose of the coolant system and a female radiator hose adapter for attachment to the radiator hose port on the radiator or to a thermostat housing for the coolant system, said attachment devices having a hose connected thereto, said hose attachable to said ports on said service device.

3. The pressure-vacuum fluid handling system as set forth in claim 1 in which said attachment devices comprises: a pressure line attachable one of said ports on said service device to provide either new coolant or recycled coolant, a vacuum line attachable to one of said ports on said service device for removing coolant from a vehicle and introducing the coolant to the pressure-vacuum fluid handling system, a pressure gauge on said pressure line to monitor coolant pressure, a vacuum gauge on said vacuum line to monitor vacuum, a pressure valve on said pressure line to open or close coolant flow, a suction valve on said vacuum line to open or close said vacuum line, a vacuum proportioning valve plumbed in parallel alignment with said vacuum valve to control vacuum during dual operation of pressure and vacuum, a coupled dual valve plumbed parallel with said pressure valve and with said suction valve after said vacuum proportioning valve to provide dual control of pressure and vacuum when removing and replacing coolant, a flow meter on a combined output of said pressure valve and a pressure side of said coupled dual valve to monitor flow into the vehicle's coolant system, a pressure port at an output of said flow meter for attachment of an adapter connectable to a vehicle's coolant system, and a vacuum port at a combined output of said suction valve and a vacuum side of said coupled dual valve for attachment of an adapter connectable to the vehicle's coolant system for the removal of the coolant.

4. The pressure-vacuum fluid handling system as set forth in claim 3 in which said attachment device further comprises an inline filter and a flush pump, said flush pump drawing coolant from the vehicle's coolant system through said vacuum port and through said inline filter and returning the filtered coolant through said pressure port to the vehicle's coolant system.

5. The pressure-vacuum fluid handling system as set forth in claim 1 in which said recycling tank further comprises an agitation means located within said recycling tank for mixing coolant and chemical treatments and to prevent settling of contaminants within said recycling tank.

6. The pressure-vacuum fluid handling system as set forth in claim 5 in which said agitation means comprises an aeration device on the bottom of said recycling tank, said aeration device using compressed air to agitate and mix the tank content.

7. The pressure-vacuum fluid handling system as set forth in claim 1 in which said waste holding tank further comprises a pickup port for removal of waste coolant from said waste holding tank for proper disposal.

8. The pressure-vacuum fluid handling system as set forth in claim 1 in which said vacuum means comprises a vacuum pump.

9. The pressure-vacuum fluid handling system as set forth in claim 1 further including check valves to prevent coolant from said waste holding tank and said recycling tank from entering said vacuum means.

10. The pressure-vacuum fluid handling system as set forth in claim 1 in which said plurality of filters comprise a bank of four filters in series for filtering particulate matter from said coolant.

11. The pressure-vacuum fluid handling system as set forth in claim 1 in which the treatment of coolant within said recycling tank includes addition of chemicals for precipitation and solidification of dissolved and suspended matter within the coolant for removal by said plurality of filters.

12. The pressure-vacuum fluid handling system as set forth in claim 1 in which said delivery means comprises regulated air pressure supplied to said new premixed coolant delivery tank and said recycled coolant delivery tank to provide pressure for delivery of new or recycled coolant to said service devices.

13. The pressure-vacuum fluid handling system as set forth in claim 1 in which said delivery means comprises liquid transfer pump to pump coolant at a regulated pressure from said new premixed coolant delivery tank and said recycled coolant delivery tank to said service devices.

14. The pressure-vacuum fluid handling system as set forth in claim 1 further comprising a hot flush device; said hot flush device comprising an inline filter, a flush pump and a fluid heating device all being fluidly connected in series, said hot flush device having an input from one of said ports on said service devices to said inline filter and an output from said flush pump to another port on said service device.

15. A pressure-vacuum fluid handling system comprising:

a central system containing a waste holding tank, a recycling tank, a plurality of filters, a new premixed coolant delivery tank, a recycled coolant delivery tank, a vacuum means, an injection means, a treatment means, and a delivery means; said vacuum means supplying a vacuum to said waste holding tank and said recycling tank for drawing coolant from a coolant system into either said waste holding tank or said recycling tank, said treatment means adding chemicals for treatment of coolant within said recycling tank, said plurality of filters plumbed between said recycling tank and said recycling coolant delivery tank for filtering coolant as treated coolant is transferred between said recycling tank and said recycled coolant delivery tank; said injection means for injecting chemicals into the treated and filtered coolant to restore coolant to original chemical specifications; said new premixed coolant delivery tank for receiving and mixing new anti-freeze and water to create a new premixed coolant; said delivery means providing a means of extracting coolant under pressure from said recycled coolant delivery tank and said new premixed coolant delivery tank;

a plurality of service devices, each service device being identical and located at a service bay or other area in which service on a coolant system is performed and each having a plurality of ports, said ports on each of said service device being either suction ports or pressure ports: one of said suction ports being connected by a suction line to said waste holding tank, another suction port being connected by a second suction line to said recycling tank, coolant from the coolant system is sucked from the coolant system through one of said suction ports for transfer to either said recycling tank or said waste holding tank; one pressure port is connected by a pressure line to said new premixed coolant delivery tank, another pressure port is connected by a second pressure line to said recycled coolant delivery tank, said pressure ports receiving coolant under pressure from said new premixed coolant delivery tank and said recycled coolant delivery tank for delivery of coolant to the coolant system: and an attachment means attachable to the coolant system and to said service device, said attachment means attachable to a radiator, radiator hose and overflow port on the cooling system, coolant from the coolant system is removed by suction and replaced at the same time under pressure though said attachment means attached to said suction and pressure ports on said service device.

16. The pressure-vacuum fluid handling system as set forth in claim 15 further comprising a hot flush device; said hot flush device comprising an inline filter, a flush pump and a fluid heating device all being fluidly connected in series, said hot flush device having an input from one of said ports on said service devices to said inline filter and an output from said flush pump to another port on said service device.

17. A pressure-vacuum fluid handling system comprising;

attachment means consisting of adapters that connect to a vehicles coolant system, said attachment means providing coolant under pressure and removing coolant by vacuum;

service devices having a plurality of ports for attachment of said attachment means, a recycling tank fluidly connected to one of said ports on each of said service devices for treatment and storage of recyclable coolant;

a waste holding tank fluidly connected to one of said ports on each of said service devices;

a vacuum means providing vacuum to said recycling tank and said waste holding tank, said vacuum means drawing coolant from a coolant system through said attachment means, said ports on said service devices and into said recycling tank and said waste holding tank;

a plurality of filters fluidly connected to said recycling tank for filtering recyclable coolant from said recycling tank;

a recycled coolant delivery tank fluidly connected to an output of said plurality of filters for receiving and chemically balancing recycled coolant and having an output fluidly connected to one of said ports on each of said service devices;

a new premixed coolant delivery tank for receipt and mixing water and new anti-freeze in fluid connection with one of said ports on each of said service devices; and a pressure means to provide coolant under pressure from said recycled coolant delivery tank and said new premixed coolant delivery tank to said service devices and through said attachment means for delivery into the coolant system.

18. The pressure-vacuum fluid handling system as set forth in claim 17 further comprising a hot flush device; said hot flush device comprising an inline filter, a flush pump and a fluid heating device all being fluidly connected in series, said hot flush device having an input from one of said ports on said service devices to said inline filter and an output from said flush pump to another port on said service device.

* * * * *